US006971373B2

(12) United States Patent
Mudway et al.

(10) Patent No.: US 6,971,373 B2
(45) Date of Patent: Dec. 6, 2005

(54) CONTROL SYSTEM

(75) Inventors: John Anthony Mudway, Worcestershire (GB); Paul Manwaring Maker, Wrentham, MA (US)

(73) Assignee: Goodrich Control Systems Limited, Bedfordshire (GB)

( * ) Notice: Subject to any disclaimer, the term of this patent is extended or adjusted under 35 U.S.C. 154(b) by 243 days.

(21) Appl. No.: 10/361,778

(22) Filed: Feb. 10, 2003

(65) Prior Publication Data

US 2003/0183205 A1 Oct. 2, 2003

(30) Foreign Application Priority Data

Feb. 9, 2002 (GB) ..... 0203071

(51) Int. Cl.[7] ..... F02M 33/04

(52) U.S. Cl. ..... 123/497; 123/198 D

(58) Field of Search ..... 123/495, 497, 123/198 D, 198 DB

(56) References Cited

U.S. PATENT DOCUMENTS

| | | | | |
|---|---|---|---|---|
| 3,845,841 | A * | 11/1974 | Kloefkorn | 180/69.4 |
| 4,726,335 | A * | 2/1988 | Brauninger | 123/198 D |
| 4,763,621 | A * | 8/1988 | Stevens | 123/198 D |
| 4,827,897 | A * | 5/1989 | Yamada et al. | 123/497 |
| 4,874,013 | A * | 10/1989 | Hack, Jr. | 137/571 |
| 6,305,357 | B1 * | 10/2001 | Soukeras | 123/495 |
| 6,536,415 | B2 * | 3/2003 | Joos et al. | 123/497 |

* cited by examiner

*Primary Examiner*—Thomas N. Moulis
(74) *Attorney, Agent, or Firm*—Brown Raysman Millstein Felder & Steiner LLP

(57) ABSTRACT

A fuel control system for controlling the supply of fuel to an engine, the control system comprising:

pump means for providing a flow of fuel to said engine;

first and second drive means for driving said pump means; and, control means for controlling said first and second drive means; wherein, said control means is arranged to control said first and second drive means such that in the event of failure of one of said first and second drive means, said pump means is driven by the other of said first and second drive means.

10 Claims, 2 Drawing Sheets

CONTROL SYSTEM

BACKGROUND OF THE INVENTION

The present invention relates to a control system for controlling the fuel supply to a combustion engine or the like.

Combustion engines, including internal combustion engines and gas turbine engines, generally require a constant, though often variable, flow of fuel to be supplied thereto in order to operate correctly. Fuel, usually in a liquid state, is pumped from a tank or other fuel store along a fuel line by means of a fuel pump and supplied to the engine at a predetermined pressure. The pump is often driven by means of a motor whose speed can be controlled so as to increase or decrease the flow rate of the fuel supplied to the engine by the pump.

Correct operation of the pump is essential to the performance of the engine since failure of the fuel supply may cause the engine to shut down. This may have potentially dangerous consequences, for example, where the engine is an aircraft engine. It would be advantageous to provide a fuel control system for a combustion engine that contains some form of back up or redundancy and provides for failure or incorrect operation of the fuel pump and/or the associated motor.

It is an aim of the present invention, therefore, to provide a fuel supply control system for a combustion engine which addresses this problem.

SUMMARY OF THE INVENTION

Accordingly, the present invention provides a control system for controlling the supply of fuel to an engine, the control system comprising:

pump means for providing a flow of fuel to said engine;

first and second drive means for driving said pump means;

and control means for controlling said first and second drive means; wherein, said control means is arranged to control said first and second drive means such that in the event of failure of one of said first and second drive means, said pump means is driven by the other of said first and second drive means.

In a first embodiment, the pump means comprises first and second fuel pumps, each fuel pump being arranged to be driven by a respective one of the first and second drive means.

Preferably, each of said first and second drive means comprises an electric motor. The control means is advantageously operable to control the operation and/or speed of each motor independently, thereby to independently control the flow of fuel provided to the engine by each of the fuel pumps.

Conveniently, during normal operation of the system, the control means is arranged to control the first electric motor to drive the first fuel pump, thereby to provide a flow of fuel to the engine and control the second electric motor to maintain an off state such that the second fuel pump is not driven. Advantageously, however, in the event of failure of the first fuel pump and/or the first electric motor, the control means controls the second electric motor to drive the second fuel pump thereby to maintain the flow of fuel to the engine.

Conveniently, the first and second fuel pumps have a respective first and second bypass valve connected in parallel therewith, each bypass valve being operable to switch between a first, closed position in which the bypass valve prevents flow of fuel therethrough and a second, open position in which the bypass valve permits the flow of fuel therethrough thereby to bypass the respective fuel pump. Advantageously, each bypass valve is arranged to switch between said first and second positions in dependence on the operation of the associated fuel pump and electric motor.

During normal operation of the system, therefore, the control means is arranged to control the first electric motor to drive the first fuel pump, thereby to provide a flow of fuel to the engine. The second electric motor is deactivated by the control means and the second fuel pump is bypassed by means of the second bypass valve. However, in the event of failure or incorrect operation of the first fuel pump or the first motor, the control means is arranged to control the second motor to drive the second fuel pump, thereby to maintain the flow of fuel to the engine, and the first fuel pump is bypassed by means of the first bypass valve.

In a second embodiment of the invention, the pump means comprises a single fuel pump having first and second, mutually engaged, drivable gears.

In this second embodiment, each of the first and second drivable gears is arranged to be driven by a respective one of the first and second drive means.

Advantageously, each of the first and second drive means comprises a respective electric motor. Conveniently, the control means is arranged to control the first and second motors such that, in normal operation, said first electric motor drives said fuel pump but in the event of failure or incorrect operation of the first electric motor, said second motor drives the fuel pump.

Alternatively, or in addition, clutch means may be provided between said first motor and said first gear and between said second motor and said second gear.

Advantageously, therefore, the control means may be arranged to control the first and second electric motors such that, in normal operation, both of said first and said second electric motors drive said pump means but in the event of failure or incorrect operation of one of said first or said second electric motors, the clutch means associated with the failed electric motor disengages the failed electric motor from its respective gear and said fuel pump is driven only by the other electric motor, thereby to maintain a flow of fuel to the engine.

BRIEF DESCRIPTION OF THE DRAWINGS

The present invention will now be described, by way of example only, with reference to the accompanying drawings in which.

DETAILED DESCRIPTION

Figure 1:
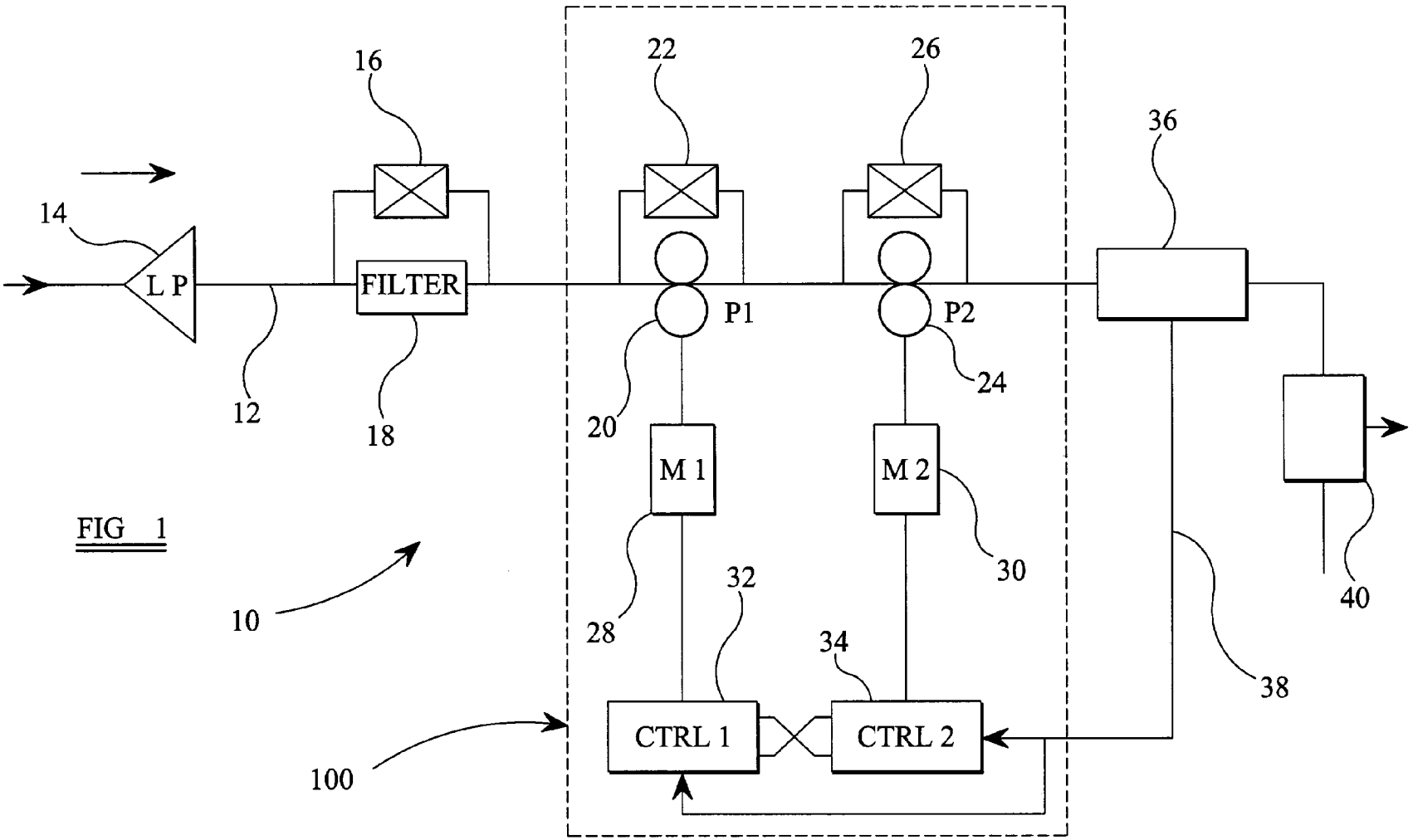
FIG. 1 is a schematic block diagram of a first form of control system according to the invention.

Referring to FIG. 1, a first form of control system according to the invention is shown generally at 10. Fuel supplied to the system 10 from a fuel tank or other store (not shown) on a fuel line 12 by means of a low pressure pump 14. The fuel is passed, at a low pressure, through a filter 18 across which a bypass valve 16 is connected.

Pump means including first and second positive displacement fuel pumps 20, 24 are connected to the fuel line 12 in a series arrangement, the first fuel pump 20 being located on the fuel line 12 "upstream" of the second fuel pump 24. Each of the first and second fuel pumps 20, 24 is arranged to be driven by a respective electric motor 28, 30. Control means, in the form of first and second motor controllers 32, 34, are connected to the first and second electric motors 28, 30 respectively and are arranged to control the operation and speed thereof. Although the first and second motor controllers 32, 34 are operable to control the operation of the respective electric motor independently, both motor controllers are interconnected for communication therebetween as described below.

The first fuel pump 20 is provided with a first one-way valve 22 connected across it. The first one-way valve 22 acts primarily as a pressure relief valve (PRV) but, during certain modes of operation of the system 10 as described below, serves to act as a bypass valve across the first fuel pump 20. Likewise, the second fuel pump 24 is provided with a second one-way valve 26 connected across it. During certain modes of operation of the system 10, the second one-way valve 26 serves to act as a bypass valve across the second fuel pump 24.

A fuel flow-sensing valve 36 is located in the fuel line 12, downstream of the second fuel pump 24, for monitoring the rate of fuel flow through the fuel line 12. The flow-sensing valve 36 includes a linear variable differential transformer (LVDT—not shown) for monitoring the position of a valve member (not shown) forming part of the flow sensing valve 36. The LVDT is operable to provide an output signal which is indicative of the rate of flow of fuel along the fuel line 12 and which is supplied by the LVDT to a respective control input of each of the first and second motor controllers 32, 34 via an output control line 38. The first and second motor controllers 32, 34 are operable to control the operation and speed of the respective electric motor connected thereto in dependence on the output signal from the LVDT.

The control system 10 also includes a pressure raising valve, also known as a pressure raising shut-off valve (PRSOV) 40 arranged in the fuel line 12. The PRSOV 40 is arranged to control the fuel pressure in the fuel line 12 and to automatically shut off the flow of fuel to the engine (not shown) if the pressure in the fuel line 12 drops below a predetermined threshold level.

In operation, fuel from the fuel tank is supplied to the control system 10 on the fuel line 12 by means of the low pressure pump 14. The fuel flows through the filter 18 and is supplied to the first fuel pump 20. If the filter 18 becomes blocked with contaminant, the bypass valve 16 is arranged to permit a flow of unfiltered fuel to bypass the filter 18, for supply directly to the inlet of the fuel pump 20.

During normal operation of the system 10, the first motor controller 32 controls the first electric motor 28 to drive the first fuel pump 20, thereby to supply fuel at a high pressure to the engine. The operative status of the first electric motor 28 is communicated by the first motor controller 32 to the second motor controller 34, the latter thereby controlling the second electric motor 30 to be maintained in an off state so that, the second fuel pump 24 is not driven.

The increase in fuel pressure in the fuel line 12 caused by the stationary second fuel pump 24 causes the second PRV 26 to open, thereby allowing the flow of fuel in the fuel line 12 to bypass the second fuel pump 24 through a substantially unrestricted flow path. The flow of fuel to the engine provided by the first fuel pump 20 is monitored by the flow sensing valve 36 and the LVDT associated therewith generates an output signal and supplies this to the first motor controller 32 via the output control line 38. If the flow rate of the fuel in the fuel line 12 drops below the required rate, the first motor controller 32 increases the speed of the first electric motor 28 thereby to increase the fuel flow generated by the first fuel pump 20. Conversely, if the flow rate of the fuel in the fuel line 12 increases beyond the required rate, the first motor controller 32 decreases the speed of the first electric motor 28, thereby to decrease the fuel flow generated by the first fuel pump 20.

The fuel pressure in the fuel line 12 is monitored by the PRSOV 40 to ensure that fuel is supplied to the engine at a minimum threshold pressure.

In the event that the first fuel pump 20 and/or the first electric motor 28 either fails or develops an operational fault, this anomaly is manifested in a change in the flow rate of the fuel along the fuel line 12 which is detected by the flow sensing valve 36. The flow sensing valve 36 generates an output signal indicative of the error in the fuel flow rate and applies this signal to the respective control input of the first and second motor controllers 32, 34.

On receipt of the control signal from the flow-sensing valve 36, the first motor controller 32 operates to shut down the first electric motor 28 and hence discontinue driving the first fuel pump 20. Conversely, on receipt of the control signal from the flow sensing valve 36, the second motor controller 34 controls the second electric motor 30 to switch to an on state, thereby to begin driving the second fuel pump 24.

In the event that the second fuel pump 24 is in operation and the first fuel pump 20 is halted, the decrease in fuel pressure within the fuel line 12 downstream of the first fuel pump 20 causes the first PRV 22 to open, thereby allowing the flow of fuel in the fuel line 12 to bypass the first fuel pump 20. Similarly, there is an increase in pressure at the discharge of the second fuel pump 24 which causes the second PRV 26 to close, thereby ensuring that the fuel flow to the engine is maintained substantially unaffected through the second fuel pump 24.

It can be seen that the system 10 provides for redundancy of both the fuel pump and the electric motor such that if either fails the second fuel pump and electric motor are able to maintain the flow of fuel to the engine.

Figure 2:
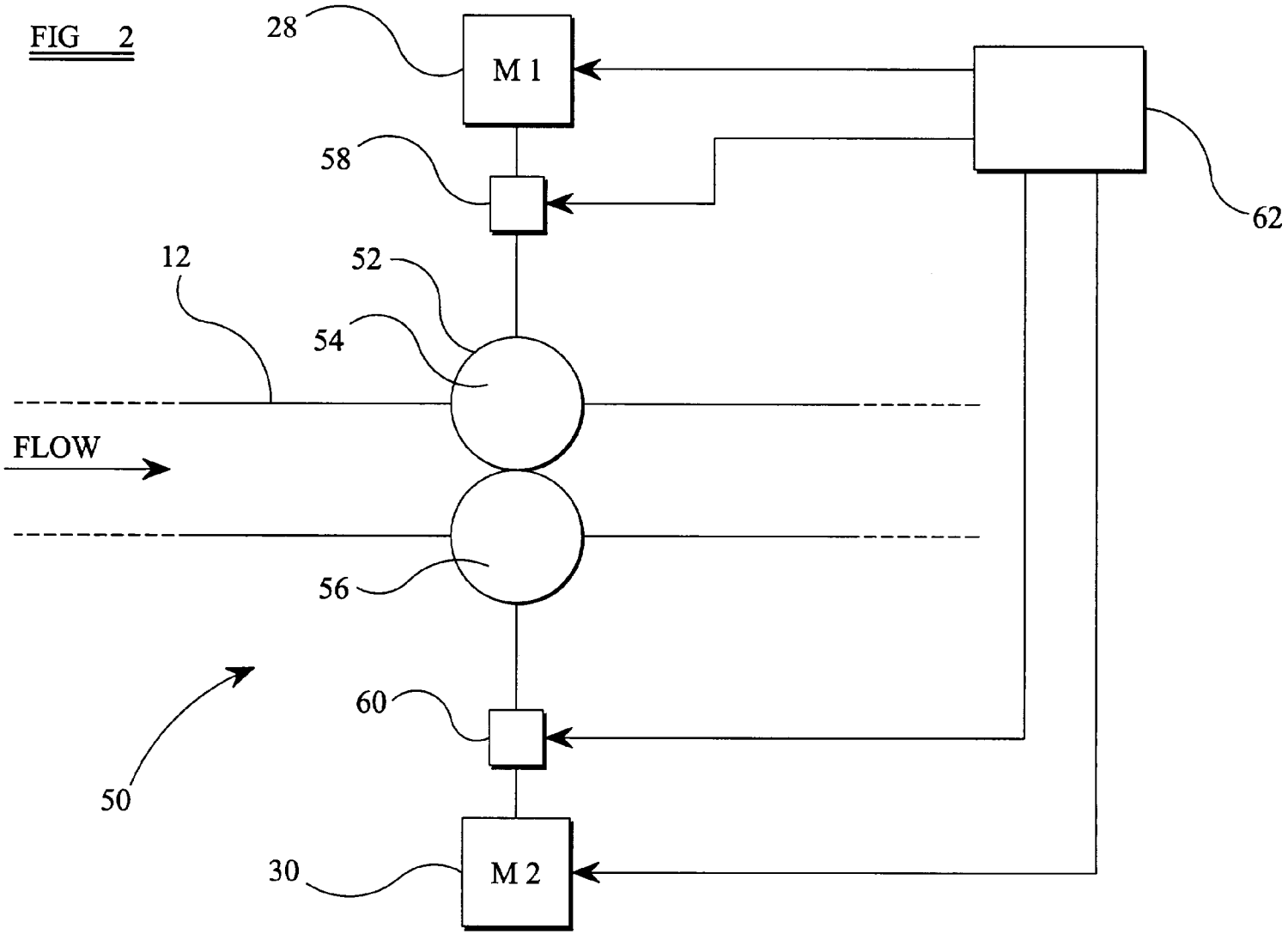
FIG. 2 is a schematic block diagram of a second form of control system according to the invention.

Referring now to FIG. 2, a control system according to a second embodiment of the invention is shown generally at 50. The system shown in FIG. 2 is intended to replace the part of the system of FIG. 1 which is denoted by the dashed line 100. In this embodiment, therefore, the first and second fuel pumps 20, 24 of FIG. 1 are replaced by a single gear pump 52. Such a gear pump is conventional in form and an example of such is described in British Patent No. 1,128,051 in the name of the present applicant.

The gear pump thus comprises a first gear 54, connected to and driven by a first electric motor 28 and a second gear 56, in driving engagement with the first gear 54, the second gear 56 being connected to and driven by a second electric motor 30. In practice, it is envisaged that the second gear may constitute the idler gear found in conventional gear pumps such as that described in British Patent No. 1,128,051.

Drive is transmitted from the first electric motor 28 to the first gear 54 of the fuel pump 52 via a first clutch assembly 58. Likewise, drive from the second electric motor 30 is transmitted to the second gear 56 of the fuel pump 52 via a second clutch assembly 60. As described below, the first and second clutch assemblies 58, 60 are arranged to selectively disconnect drive from the respective electric motor to the respective gear in the gear pump in the event that one of the electric motors becomes seized.

The control system includes a motor controller 62 which is connected to both the first and second electric motors 28, 30 for controlling the operation and/or speed thereof. In addition, in the embodiment of FIG. 2, the motor controller 62 is connected to each of the first and second clutch assemblies 58, 60 for controlling the operation thereof. In an alternative embodiment (not shown), a separate motor controller may be provided for each clutch assembly 58, 60.

In operation, fuel is supplied to the fuel pump 52 from the fuel tank (not shown) on the fuel line 12 via the low pressure pump (14, as shown in FIG. 1). The motor controller 62 controls the operation of the first electric motor 28 to drive the first gear 54 of the fuel pump 52 via the first clutch assembly 58. At the same time, the motor controller 62 controls the second electric motor 30 to remain at idle.

Thus, drive is transmitted from the first electric motor 28 to the first gear 54 of the fuel pump 52 via the first clutch assembly 58. This drive is then transmitted through the second gear 56, meshing with the first gear 54, to the second electric motor 30, which is set at idle by the motor controller 62, via the second clutch assembly 60. It will be appreciated that since the second electric motor 30 is set at idle by the motor controller 62, it is able to rotate substantially freely with the second gear 56, being driven by the first gear 54.

In the event that the first electric motor 28 fails and is unable to rotate, the motor controller 62 controls the first clutch assembly 58 to disconnect the first electric motor 28 from the first gear 54 of the fuel pump 52 and, substantially simultaneously, controls the second electric motor 30 to drive the second gear 56 in the fuel pump 52 via the second clutch assembly 60. Since drive between the first gear 54 and the first electric motor 28 has been disconnected by the first clutch assembly 58, the first gear 54 is able to rotate substantially freely under the driving influence of the second gear 56, itself being driven by the second electric motor 30. The fuel pump 52 thus is able to continue normal operation and maintain the flow of fuel to the engine.

It can be seen that, in the embodiment of FIG. 1, two separate fuel pumps 20, 24, each driven by a respective electric motor 28, 30, are provided on the fuel line and are controlled independently such that if one fails or begins to malfunction, the other is able to maintain normal operation of the fuel supply system.

In the embodiment of FIG. 2, a single fuel pump is provided in the fuel supply system but is driven by two separate electric motors which are controlled independently such that if one motor fails, the other motor is able to drive the fuel pump to ensure normal operation and continued supply of fuel to the engine.

It will be appreciated by those skilled in the art that various modifications and improvements can be made to the systems of FIGS. 1 and 2. In particular, in FIG. 2, the motor controller 62 may control both the first and second electric motors 28, 30 to drive the first and second gears of the fuel pump 52 simultaneously. This would advantageously enable smaller electric motors and lower power circuitry to be used. In the event of failure or seizure of one of the electric motors, the respective clutch assembly would operate as described above to disconnect drive from the seized motor to the fuel pump thereby enabling the fuel pump to continue to be driven by the remaining functioning electric motor.

Each of the clutch assemblies 58, 60 may be arranged to disengage drive between their respective electric motor and the fuel pump 52 automatically in the event of failure or seizure of the motor. This may be achieved, for example, by means of an overrun centrifugal clutch assembly which automatically disengages drive from the lower speed motor and the pump when the rotation speed of the motor falls.

For both of the systems described previously, the first and second motors 28, 30 may be driven simultaneously, either at substantially the same speed or with one driven at a slightly lower speed than the other. The main advantage of this occurs in recovery following failure of the first motor or drive electronics. As the second motor is already rotating at close to the correct speed, it assumes the pump load much more quickly and, hence, the magnitude and duration of any disturbance to fuel flow supplied to the engine will be reduced.

It can be seen that the control system of the present invention provides for redundancy in the fuel supply system to a combustion engine such that in the event of incorrect operation or failure of a fuel pump or the electric motor driving the fuel pump, a substantially continuous flow of fuel to the engine can be maintained by the system.

What is claimed is:

1. A fuel control system for controlling the supply of fuel to an engine, the control system comprising:
   - pump means for providing a flow of fuel to said engine;
   - separate first and second electric motors for driving said pump means; and
   - control means for controlling said first and second electric motors;
   - wherein, said control means is arranged to control said first and second electric motors such that in the event of failure of one of said first and second electric motors, said pump means is driven by the other of said first and second electric motors.

2. A fuel control system as claimed in claim 1 wherein said pump means comprises first and second fuel pumps, each fuel pump being arranged to be driven by a respective one of the first and second electric motors.

3. A fuel control system as claimed in claim 2 operable independently to control the operation and/or speed of each motor, thereby independently to control the flow of fuel provided to the engine by each of the fuel pumps.

4. A fuel control system as claimed in claim 3, wherein said control means is arranged to control the first electric motor to drive the first fuel pump, thereby to provide a flow of fuel to an engine and to control the second electric motor to maintain an off state such that the second fuel pump is not driven, and, in the event of failure of the first fuel pump and/or the first electric motor, to control the second electric motor to drive the second fuel pump thereby to maintain the flow of fuel to the engine.

5. A fuel control system as claimed in claim 2 wherein the first and second fuel pumps have a respective first and second bypass valve connected in parallel therewith, each bypass valve being operable to switch between a first, closed position in which the bypass valve prevents flow of fuel therethrough and a second, open position in which the bypass valve permits the flow of fuel therethrough thereby to bypass its respective fuel pump.

6. A fuel control system as claimed in claim 5 wherein, each bypass valve is arranged to switch between said first and second positions in dependence on the operation of the associated fuel pump and motor.

7. A fuel control system as claimed in claim 1 wherein said pump means comprises a single fuel pump having first and second, mutually engaged, drivable gears.

8. A fuel control system as claimed in claim 7 wherein each of said first and second drivable gears is arranged to be driven by a respective one of the first and second electric motors.

9. A fuel control system as claimed in claim 8 wherein the control means is arranged to control the first and second motors such that, in normal operation, said first electric motor drives said fuel pump but in the event of failure or incorrect operation of the first electric motor, said second motor drives the fuel pump.

10. A fuel control system as claimed in claim 8 wherein clutch means is provided between said first electric motor and said first gear and between said second electric motor and said second gear.

* * * * *